United States Patent [19]

Téchy

[11] Patent Number: 4,583,601

[45] Date of Patent: Apr. 22, 1986

[54] HAMMER DRILL

[75] Inventor: Marcel Téchy, Fontaine l'Eveque, Belgium

[73] Assignee: Stenuick Freres, Fontaine l'Eveque, Belgium

[21] Appl. No.: 501,735

[22] Filed: Jun. 6, 1983

[30] Foreign Application Priority Data

Jun. 4, 1982 [FR] France ..... 82 09774

[51] Int. Cl.[4] ..... E21B 1/00

[52] U.S. Cl. ..... 173/134; 173/15

[58] Field of Search ..... 173/134–136, 173/138, 13, 15–17; 123/46 SC, 46 H, 46 R; 239/87, 91, 92; 227/9–11

[56] References Cited

U.S. PATENT DOCUMENTS

| | | | |
|---|---|---|---|
| 2,052,459 | 8/1936 | Geiser | 239/87 |
| 2,396,627 | 3/1946 | Wohlmeyer | 173/136 |
| 2,559,364 | 6/1951 | Mashinter | 239/92 X |
| 2,875,737 | 3/1959 | Ueckert | 173/135 |
| 2,948,122 | 8/1960 | Smith | 173/131 |
| 2,950,705 | 8/1960 | Kuhn | 173/134 X |
| 3,640,350 | 2/1972 | Stenuick | 173/135 X |

*Primary Examiner*—Donald R. Schran
*Assistant Examiner*—James Wolfe
*Attorney, Agent, or Firm*—Pollock, Vande Sande & Priddy

[57] ABSTRACT

A "hole bottom" hammer drill comprising a tubular body (1) supplied with compressed air, a drill bit (3) and a percussion piston (38) caused to move in an inner cylinder (7) by a mechanism distributing compressed air alternately below and above the piston.

The hammer drill includes a device (29) for injecting gas oil into the chamber (71) above the piston (38) and a mechanism (34, 35) for triggering the injection during the upward stroke of the piston (38); the additional compression effects the combustion of the air-gas oil mixture, thus projecting the piston (38) towards the drill bit (3).

5 Claims, 8 Drawing Figures

HAMMER DRILL

FIELD OF THE INVENTION

The present invention relates to a hammer drill, more particularly to a hammer drill of the "hole bottom" type, i.e., one intended to work on the actual bottom of the hole which is being drilled.

Appliances of this kind usually work with compressed air and are disposed at the end of a string of pipes which serve simultaneously for transmitting the operating compressed air to them and for the thrust and general rotary movement for regulating the action of the drill bit at the bottom of the hole.

BACKGROUND OF THE INVENTION

Pneumatic hammers intended to work at the bottom of the hole generally comprise a tubular body supplied with compressed air, a distribution mechanism, a percussion piston, and a bit receiving the blows of the percussion piston in order to transmit them to the rock. The percussion piston is movable in a cylinder formed by a liner, and longitudinal passages are provided between the liner and the inside wall of the hammer body for the supply of the compressed air acting on the piston, while other passages serve to exhaust the air after it has acted on one face or the other of the percussion piston.

In order to enable the percussion piston to apply sufficient striking force to the bit, and consequently to the rock which is being drilled, use is made of compressed air under high pressure, for example 20 to 25 bars. The consumption, which may be of the order of 10 to 15 cubic meters at S.T.P., for example, therefore entails the use of high-output, high-pressure compressors, i.e., heavy and bulky equipment. Moreover, this equipment is expensive, both with regard to initial cost and immobilization of capital and with regard to operating costs, because of the considerable consumption of energy.

SUMMARY OF THE INVENTION

The present invention makes it possible to reduce these costs substantially, and at the same time to increase drilling power and reduce energy consumption.

The invention is concerned with a hammer drill of the "hole bottom" type, which comprises a tubular body supplied with compressed air and carrying a drill bit, and in which a liner forms a cylinder in which a percussion piston is caused to perform a reciprocating movement by a compressed air distribution mechanism, thus moving alternately into the lower chamber of the cylinder, into which the shank of the bit projects, and into the upper chamber of the cylinder opposite the bit, and at the same time alternately exhausting the upper chamber and the lower chamber.

According to the invention, the hammer drill also includes a device for injecting gas oil into the upper chamber of the cylinder, with a mechanism for triggering the injection in the rising phase of the piston corresponding to additional compression of the feed air in the upper chamber, so as to bring about the internal combustion of the air-gas oil mixture and thus violently project the piston towards the bit.

In one particular embodiment of the invention, the mechanism for triggering the injection of gas oil is controlled by the deformation of an elastic diaphragm forming a wall of an auxiliary chamber supplied with compressed air at the same time as the upper chamber of the cylinder.

BRIEF DESCRIPTION OF THE DRAWINGS

The invention will be better understood by reference to one particular embodiment given by way of example and illustrated in the accompanying drawings.

DETAILED DESCRIPTION

Figure 1:
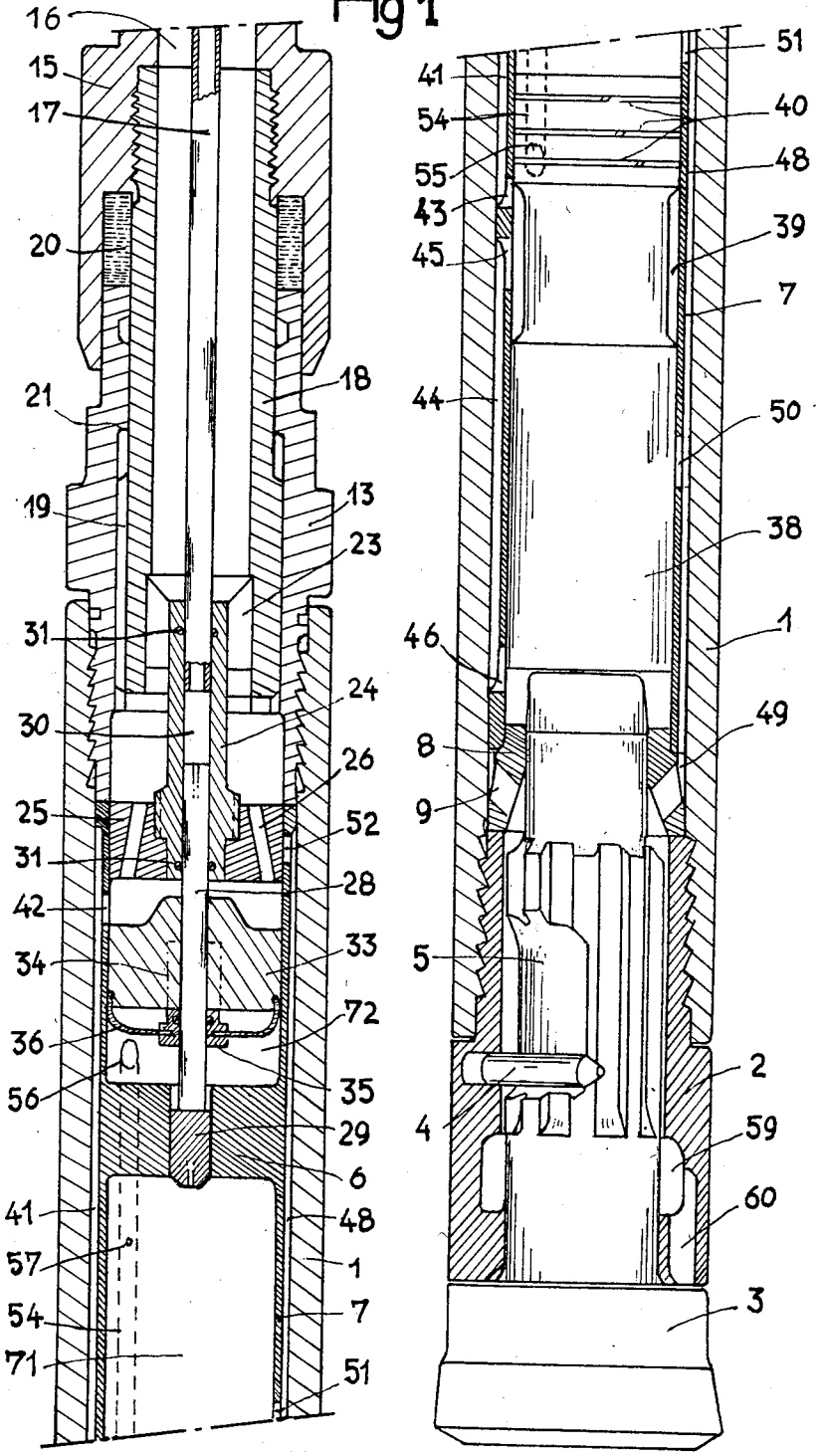
FIG. 1 is a general view, in two parts and in section in an axial plane, of a hammer drill constructed in accordance with the invention.

Referring firstly to both parts of FIG. 1, it will be seen that the main body 1 of the hammer drill is screwed at the bottom to an end piece 2 in which slides the splined shank of the drill bit 3. The shank of the bit is rotationally fixed relative to the body, and limited in respect of axial displacement, by a tangential key 4 bearing against a recess 5 in the shank.

A liner 7 inside the body 1 extends over almost the entire length of the latter. It forms two oppositely disposed shells, each open towards one end of the body, which are separated by a solid core 6. At the bottom, the liner 7 bears against a spacer ring 8 of generally conical shape, in which radial apertures 9 are formed and which in turn bears against the end piece 2. The top of the liner 7 abuts against the connector 13 screwed on the body 1. At its other end, the connector 13 receives the usual members making the connection to the pipes and rods feeding and operating the hammer drill.

The part 15, which transmits the thrust to the hammer drill, forms an annular duct 16 around a central pipe 17. The part 15, which fits over the end of the connector 13, is screwed on a hollow piston 18, whose splined bottom portion 19 permits axial sliding, without rotation, in a matching splined part inside the connector 13; the assembly 15–18 can thus slide on the connector 13. The vertical thrust on the hammer drill is therefore transmitted to the connector 13 through the compression of the pads 20, and the rotary movement through the splines 19. When, on the other hand, it is desired to raise the hammer drill, for example in order to pull it up, the lifting force is transmitted to the connector 13 by the splines of the piston 18, which rise until they strike against the shoulder 21 terminating the splines of the connector.

The bottom of the piston 18 is fastened by radial ribs 23 to a tubular member 24 screwed into a piston 25. The piston 25 is thus fastened to the piston 18 and can therefore move inside the liner 7 or inside the bore extending the latter in the connector 13, depending on whether the hammer drill is being pushed down or raised. Ducts 26 extend through the piston 25.

The end of the central pipe 17 is engaged in the central bore of the tubular member. A its other end the central bore receives a hollow needle 28, which ends in an atomizer 29 locked in the central core 6 of the liner 7. The arrangement of the internal passages in the needle 28 will be described later on in connection with FIG. 7. The fixed pipe 17 and the fixed needle 28 are thus in communication through the chamber 30 inside the member 24. When a thrust is applied to the hammer drill during the raising of the latter, the member 24 slides on the pipe 17 and on the needle 28, and the fluid-tightness of the intermediate chamber 30 is maintained by the seals 31.

The fixed needle 28 passes through the block 33, which is also fixed in the upper liner 7. The block 33 contains a piston type distributor device 34, which in this figure is shown only in silhouette in dot-dash lines, and which will be described in greater detail later on in connection with FIG. 7. This device is controlled by the displacement of a core 35 which forms the center of a flexible diaphragm fixed by its periphery in the block 33.

The inner surface of the lower part of the liner 7 serves as a guide for the sliding percussion piston 38, which is adapted to move freely between a lower position, as shown in FIG. 1 in which it is in contact with the end of the shank of the bit, and an upper position, as will be seen later on in the course of the description of the operation of the apparatus. Externally, the percussion piston 38 is provided with a circular groove 39. At the top it is provided with sealing rings 40.

Figure 2:
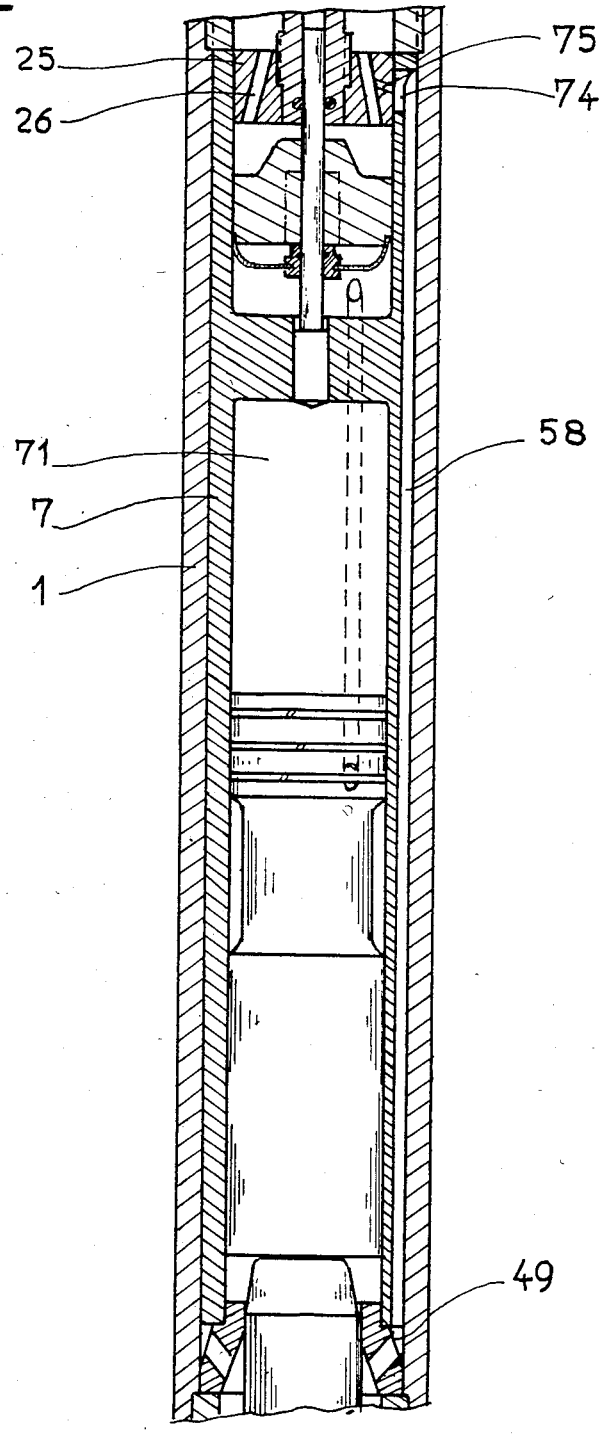
FIG. 2 is similar to FIG. 1, but shows only the central portion of the hammer drill, in section in another axial plane.

The outer surface of the liner 7 has five series of longitudinal grooves; in order to simplify the drawings, only a single groove of each type has been shown in FIGS. 1 and 2. A first series of grooves 41 brings into communication the apertures 42, which have their outlets between the block 33 and the piston 25, and the apertures 43 which have their outlets in a central position in the lower chamber formed by the liner 7.

A second series of grooves 44 brings into communication the apertures 45 and 46, both of which have their outlets inside the lower portion of the liner 7. A third series of grooves 48 leads to the annular chamber 49 surrounding the bottom ring 8; the apertures 50 and 51 pass through the wall of the lower part of the liner 7 and lead out into these grooves 48; the apertures 52, which pass through the upper wall of the liner 7, are normally closed when the piston 25 is in the lower position, as shown in the drawing. These apertures 52 are uncovered when the piston 25 is in the upper position corresponding to the raising of the hammer drill.

A fourth series of grooves 54 brings into communication the apertures 55 and 56, which lead respectively into the lower chamber 71 of the liner 7 and into the upper chamber 72 thereof, between the core 6 and the diaphragm 36. The groove 54 also has an aperture 57 of small dimensions, which leads into the upper part of the liner 7.

It will be noted that the chamber 49 around the ring 8 is in communication with the outside of the hammer drill through the ducts 9, through the clearances between the splines of the drill bit and the matching grooves in the end piece 2, and through the chamber 59 which is in communication with the outside by way of the exhaust ducts 60.

Finally, the fifth series of grooves 58 (FIG. 2) leads, like the grooves 48, into the chamber 49 and is therefore likewise in communication with the outside. At the top, the grooves 58 are each in communication through an aperture 74 with a calibrated passage 75 drilled in the part 25 and leading into one of the passages 26.

Figure 7:
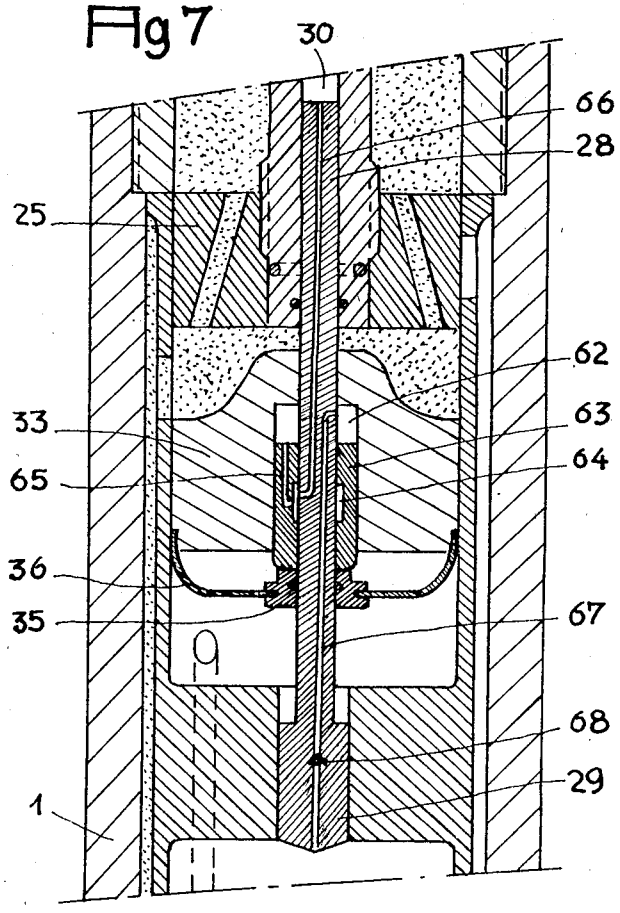

Reference can now be made to FIG. 7 in connection with additional details of the needle 28 and distributor 34. The latter is composed of an axial space 62 in which slides an annular piston 63 surrounding the needle 28. The piston 63 has an internal recess 64 which is in communication with the space 62 via ducts 65. In the needle 28 a duct 66 leads on the one hand into the chamber 30 and on the other hand into the periphery of the needle at the level of the recess 64 in the piston 63. Another duct 67 starts from the periphery of the needle at the level of the top part of the space 62, and leads to the aperture of the atomizer 29. A preset valve 68 is disposed on the duct 67.

The central pipe 17 is supplied from the surface with gas oil which passes via the chamber 30, the duct 66, the chamber 64, and the ducts 65 to fill the chamber 62 of the distributor. The gas oil also passes into the duct 67, but in the normal position, which is shown for example in FIGS. 1 and 7, it is prevented from flowing further by the preset valve 68.

The annular duct 16 is supplied from the surface with compressed air at low pressure, for example at a pressure of 6 bars.

The drawings do not show the connections for the simultaneous supply of the hammer drill with compressed air and gas oil, and they also do not show the structure of the extension pipes for connection to the surface, because this is quite conventional equipment.

Figure 3:
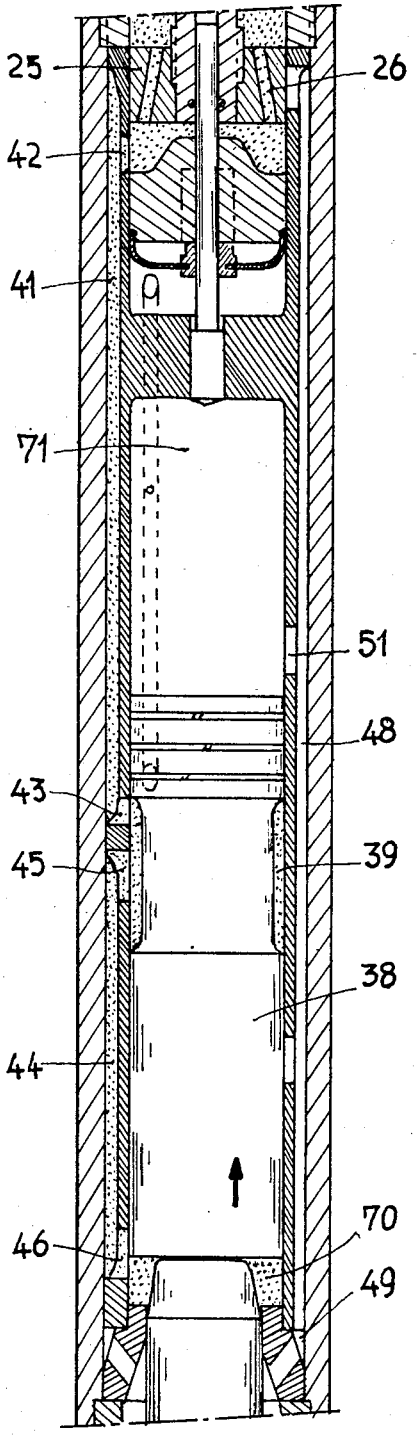
FIGS. 3 to 6 are partial views showing the successive positions of the percussion piston in the course of an operating cycle.
Figure 8:
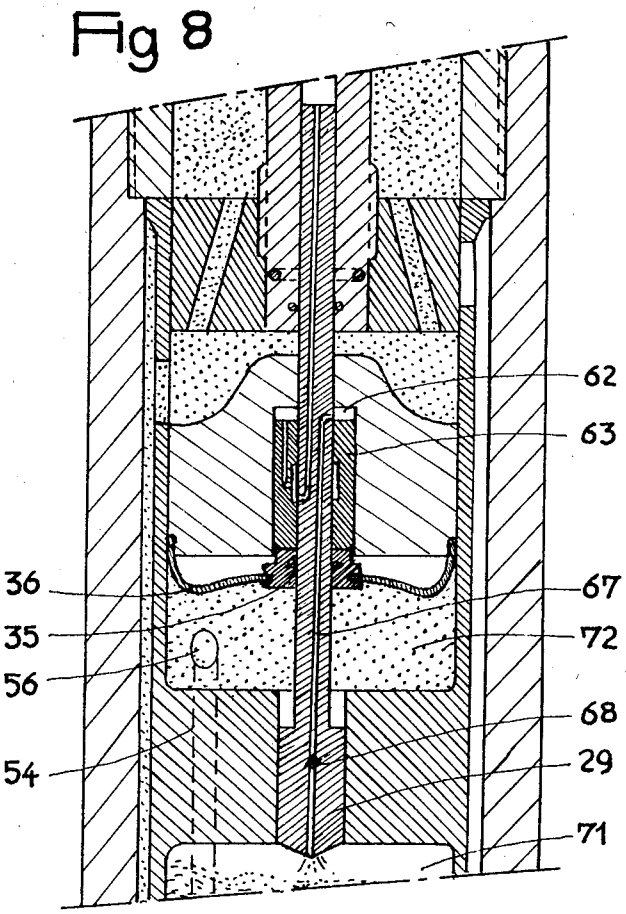
FIGS. 7 and 8 show on a larger scale the operation of the gas oil injection device, in the position, of rest and the injection position respectively.

Reference will now be made to FIGS. 3 to 6, and also to FIG. 8, in order to explain the operation of the hammer drill supplied in this manner with compressed air and gas oil. In FIG. 3, as in FIG. 1 previously referred to, the percussion piston 38 is shown in the lower position, just after its impact on the shank of the drill bit. In this position, the compressed air coming from the duct 16 fills the chamber situated above the piston 25, and by way of the ducts 26 and the apertures 42 it reaches the grooves 41. By way of the apertures 43, the groove 39 and the apertures 45, the compressed air also fills the grooves 44, and thence by way of the apertures 46 reaches the bottom chamber 70 under the percussion piston 38. The pressure in the bottom chamber 70 causes the percussion piston 38 to rise, without any reaction other than its dead weight, because the upper chamber 71 is then in free communication with the exhaust leading outside the hammer drill by way of the apertures 51, the grooves 48 and the annular chamber 49.

Figure 4:
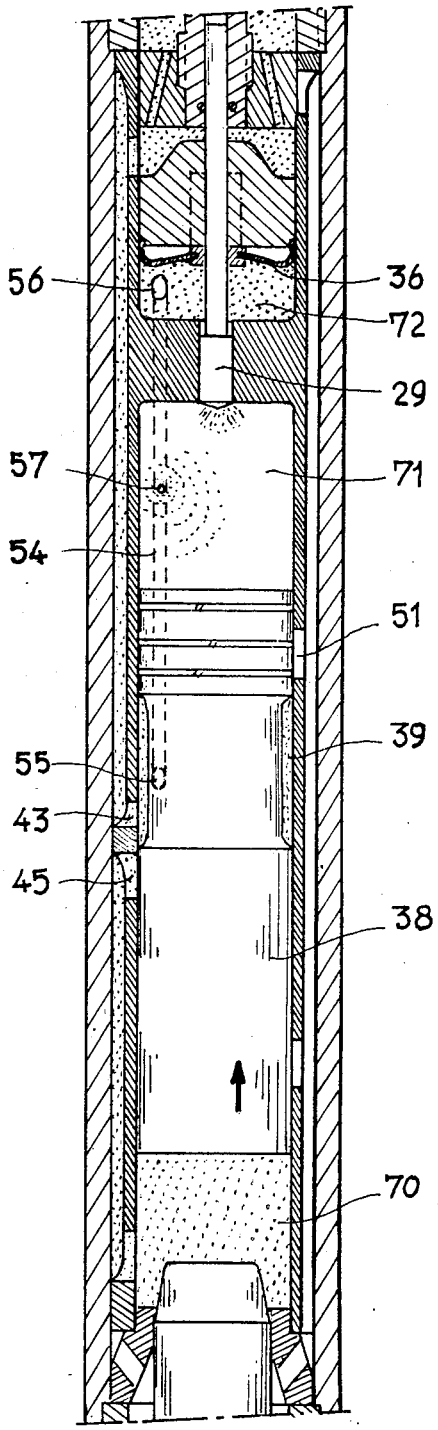

When in its upward stroke the percussion piston reaches the position shown in FIG. 4, the supply of compressed air to the chamber 70 is interrupted by the closing of the apertures 45. The groove 39 has then, however, brought the apertures 43 and 55 into communication, so that compressed air arrives in the grooves 54. Air is then introduced through the apertures 57 into the chamber 71, whose exhaust 51 has already been closed. At the same time, the compressed air is introduced through the apertures 56 into the chamber 72 situated below the elastic diaphragm 36. Reference will now be made to FIG. 8, in which it will be seen in greater detail that the pressure thus produced in the chamber 72 deforms the elastic diaphragm 36 by a crushing action, and the central core 35 drives the piston 63 into the chamber 62. The higher pressure thus produced in the chamber 62 then exceeds the preset value of the valve 28 and gas oil flows from the chamber 62 to the atomizer 29 via the duct 67. A certain amount of gas oil is thus sprayed into the chamber 71.

Figure 5:
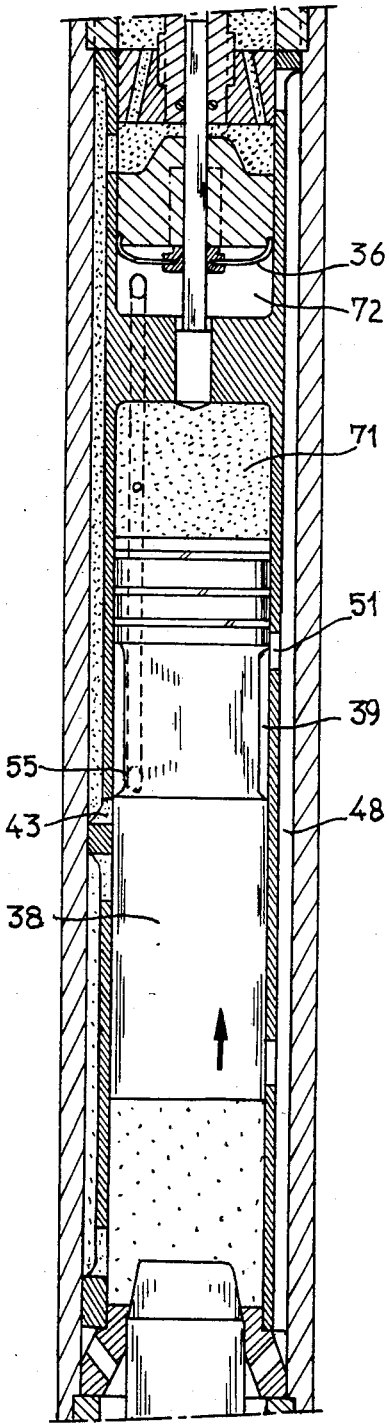
Figure 6:
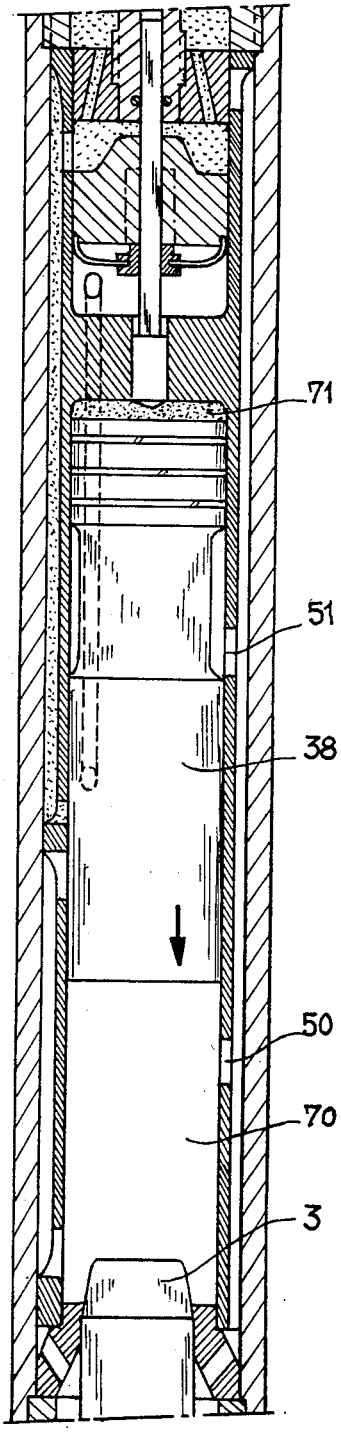

Through the impetus previously acquired the percussion piston 38 continues its upward stroke, and when it reaches the position shown in FIG. 5, the closing of the apertures 43 stops the supply of compressed air both to the chamber 71 and to the chamber 72. In addition, the groove 39, which then brings the apertures 55 and 51 into communication, connects the chamber 72 to the exhaust. The fall in pressure in this chamber 72 returns the diaphragm 36 and the piston 63 to their positions of rest, thus bringing about the termination of the spraying of gas oil into the chamber 71.

The continuation of the upward movement of the piston 38 brings about heavy compression of the mixture of air and gas oil in the chamber 71, thus causing the spontaneous ignition of the mixture. The resulting explosion violently drives the percussion piston 38 towards the shank of the drill bit 3 (FIG. 6), without back pressure because the lower chamber 70 is then connected to the exhaust by the uncovered apertures 50.

In the course of its downward stroke the percussion piston 38 first closes the exhaust 50 of the chamber 70, and then establishes communication between the exhaust and the chamber 71, from which the burned gases are evacuated through the apertures 51; the compressed air is then again supplied to the chamber 70 when the groove 39 again brings into communication the apertures 43 and 45, and the cycle can start again.

It is thus seen that in each cycle, i.e., to for each forward and return movement of the percussion piston 38, the active phase of propulsion of the percussion piston towards the drill bit is the result of the explosion of a fuel mixture, i.e., of a pressure in the chamber 71 far higher than the pressure resulting in conventional equipment from the effect of compressed air, even at high pressure of the order of 20 to 25 bars, for example. The consumption of compressed air is practically limited to that required for the upward movement of the piston, and this phase can be carried out with low pressure air, because of the benefit of the rebound effect of the shock on the end of the shank of the drill bit. The additional amount of air used in the upper chamber 71 is relatively limited, because the final compression is effected by the piston itself, and it is for that reason that the supply apertures 57 are of small diameter.

The cooling of the internal combustion engine thus incorporated in the hammer drill, and more particularly of the zone of the combustion chamber 71, is effected simultaneously by three streams of gas. A first direct cooling is effected by a continuous circulation of fresh air in the grooves 58 supplied directly by the ducts 26 and 75 and the apertures 74; the section of the ducts 75 is determined in such a manner as to branch off only a part of the compressed air of the general supply to the hammer drill, and in such a manner as not to reduce substantially the pressure in the grooves 41, which in turn have to supply the grooves 44 and 54.

The chamber 71 is in addition cooled by the fresh air circulating in the grooves 44, which is renewed in each cycle, principally for supplying the bottom chamber 70.

Finally, the body 1 of the hammer drill also participates in the cooling of the chamber 71 through the direct contact of the outer wall of the liner 7 with the inner wall of the body 1 in all the zones separating the various longitudinal grooves; a contact zone of this kind is visible in FIG. 2. The body 1 itself is cooled externally by the exhaust air coming from the bottom ducts 60 and rising in the hole along the body.

Although the drilling power of a hammer drill of this kind is far greater than that of conventional equipment, the consumption of compressed air is very greatly reduced and makes it possible to use much smaller equipment which is less expensive to purchase and less expensive in consumption of energy. The supply of compressed air at low pressure of the order of 6 bars requires in fact only connection to a customary supply system or to a compressor unit which is inexpensive to purchase and in respect of consumption. It will be noted that both the low pressure air, after it has done its work in the lower chamber 70, and the exhaust gases after explosion in the chamber 71, are still mixed together in the chamber 49 and then at the outlet of the hammer drill in the ducts 60. The total volume of gases, particularly those coming from the combustion gases in the chamber 71, is considerable, thus facilitating the blowing away of the debris around the drill bit.

I claim:

1. A hammer drill of the "hole bottom" type, comprising a tubular body (1) having a bottom portion connected to a tubular end piece (2) in which a drill bit (3) is slidingly mounted with limited axial displacement (45) by an upward projecting shank, said body (1) having a top portion connected to a tubular connector (13) in which is slidingly and sealingly received, with limited axial displacement, a hollow piston (18) connected to an annular duct forming part (15) for feeding compressed air and slidingly fitted over an upper end portion of said connector, said duct forming part (15) surrounding a fuel feeding central pipe (17) axially extending through said hollow piston and having a lower end axially engaged in a tubular member (24) which is connected to said hollow piston and to a piston (25) through which extends at least one compressed air feeding duct (26), the hammer drill further comprising a liner (7) extending inside said body and over almost the entire length of the latter, and having a central solid core (6) defining in said liner two axial chambers one of which is a lower chamber opening towards said body bottom portion, and the other being an upper chamber opening towards said body top portion, a percussion piston being sealingly and reciprocatingly mounted in said lower chamber and defining therein a combustion chamber extending above said percussion piston, between the latter and said central core (6), and a bottom chamber extending below said percussion piston and in which a top portion of said drill bit shank sealingly projects, whereas a block (33), housing a piston-type fuel distributor device (34), is in a fixed position in said upper chamber between said central core and said duct presenting piston (25), and a hollow needle (28) passes through said block (33) and has an upper end portion received in said tubular member and a lower portion locked in said central core (6) and ending in an atomizer (29) opening in said combustion chamber, said fuel distributor device being controlled by a pneumatically actuated triggering mechanism disposed in an auxiliary chamber defined in said upper chamber between said central core and said block, and said liner having an outer surface presenting several series of longitudinal grooves, each groove (41) of a first series opening through an upper aperture (42) in said upper chamber, between said block (33) and said duct presenting piston (25), and through a lower aperture (43) in a central position in said lower chamber, each groove (44) of a second series opening in said lower chamber through an upper aperture (45) at a small distance below said lower aperture of said first series grooves and through a lower aperture (46) communicationg with said bottom chamber, each groove of a third series opening in said lower chamber through an upper aperture (51) and a lower aperture (50) and having a lower end in communication with the outside of the hammer drill, and each groove of a fourth series opening in said lower chamber through a lower aperture (55), at a small distance above the lower aperture of said first series grooves, and through an intermediate small aperture leading into said combustion chamber, and each said groove of said fourth series opening further through an upper aperture in said auxiliary chamber, and said percussion piston has a central portion provided with a circular groove (39) for bringing into communication said grooves of said first and second series when said percussion piston occupies a lower position, against said drill bit shank, so that said bottom chamber is fed with compressed air flowing through said annular duct forming part (15), said hollow piston (18), each of said air feeding ducts (26) and the grooves of said first and second series (41, 44) for rising said percussion piston towards said central core, in a upward stroke, while said combustion chamber is in free communication with the outside of the hammer drill through said third series grooves and said upper aperture of the latter, said percussion piston passing in the course of said upward stroke in a position in which it closes said upper aperture of the grooves of said second and third series—and in which said piston groove (39) brings into communication said lower apertures (55, 43) of the grooves of said first and fourth series, so that compressed air is fed into said combustion chamber and said auxiliary chamber for actuating said triggering mechanism so that fuel received by said distributor device through said central pipe, said tubular member and said hollow needle is injected in said combustion chamber through said hollow needle and said atomizer, whereafter said percussion piston continues its upward stroke and passes in a position in which it closes said lower aperture of said first series grooves for stopping the supply of compressed air to said auxiliary chamber and said combustion chamber, and in which said piston groove brings into communication said lower aperture of said fourth series grooves with said upper apertures of said third series grooves for connecting said auxiliary chamber to the outside of the hammer drill so as to stop injecting fuel in said combustion chamber, said upward stroke continuing until said bottom chamber is in communication with the outside of said hammer drill through said lower aperture of said third series grooves and until there builds up in said combustion chamber a pressure high enough to cause auto-ignition of the air and fuel mixture in said combustion chamber, so that a resulting explosion drives said percussion piston towards said drill bit shank in a downward stroke in the course of which said percussion piston first closes said lower aperture of said third series grooves for exhausting combustion gases resulting from said explosion through said third series grooves, and finally strikes said shank and again establishes communication between said lower aperture of said first series grooves and said upper aperture of said second series grooves through said piston groove, so as to feed again said bottom chamber with compressed air for a following cycle.

2. A hammer drill as in claim 1, wherein said piston type fuel distributor device includes an annular piston (63) surrounding said hollow needle (28) and sliding in an axial space provided in said block (33) and forming an annular feeding chamber (62), said annular piston having an internal recess in communication with said feeding chamber via at least a duct (65) formed in said annular piston (63), said hollow needle (28) having a first inner duct (66) opening in said tubular member at said upper end portion of said needle and in the periphery of said needle at the level of said piston recess (64), and a second inner duct opening in the periphery of said needle at the level of a top part of said feeding chamber and in at least one injection aperture of said atomizer (29), and a preset valve being disposed on said second duct (67) so that, when compressed air is admitted in said auxiliary chamber, said pneumatically actuated triggering mechanism drives said annular piston into said feeding chamber (62) thus producing in the latter and in said second duct a pressure high enough to open said preset valve and allow injection of fuel through said atomizer.

3. A hammer drill as in claim 2, wherein said pneumatically actuated triggering mechanism includes a flexible diaphragm (36) having a periphery fixed in said block (33) and a central part forming an axially movable core (35) the displacements of which drive said annular piston into said feeding chamber when said flexible diaphragm is deformed when subjected to a pressure produced in said auxiliary chamber due to an admission of compressed air into said auxiliary chamber.

4. A hammer drill as in claim 1, wherein each groove of a fifth series of grooves (55) has a lower end in communication with the outside of the hammer drill and a top end in communication through an aperture (74) with a calibrated passage (75) formed in said feeding duct presenting piston (25) and opening into one feeding duct (26) for cooling the hammer drill by a continuous circulation through said grooves of said fifth series of a part of the compressed air fed to the hammer drill and branched off from said feeding duct and through said calibrated passage.

5. A hammer drill as in claim 4, wherein said liner (7) has a bottom end bearing against a spacer ring (8) of substantially conical shape and itself bearing against said end piece (2), said grooves of said third and fifth series having lower ends opening in an annular chamber (42) surrounding said spacer ring (8) in which are formed radial apertures (9) in communication with the outside of the hammer drill through clearances between splines of a central portion of said shank and matching grooves in said end piece (2) and through an annular exhaust chamber (59) provided in said end piece (2) around said shank and in communication with the outside through at least one exhaust duct provided in said end piece.

* * * * *